US010053794B2

(12) United States Patent
Arvin et al.

(10) Patent No.: US 10,053,794 B2
(45) Date of Patent: Aug. 21, 2018

(54) ELECTROPLATING SYSTEM AND METHOD OF USING ELECTROPLATING SYSTEM FOR CONTROLLING CONCENTRATION OF ORGANIC ADDITIVES IN ELECTROPLATING SOLUTION

(71) Applicant: GLOBALFOUNDRIES INC., Grand Cayman (KY)

(72) Inventors: Charles L. Arvin, Savannah, GA (US); Glen N. Biggs, Wappingers Falls, NY (US); Phillip W. Palmatier, Hopewell Junction, NY (US); Joseph C. Sorbello, Wappingers Falls, NY (US); Tracy A. Tong, Wallkill, NY (US); Freddie Torres, Beacon, NY (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 0 days.

(21) Appl. No.: 15/708,281

(22) Filed: Sep. 19, 2017

(65) Prior Publication Data

US 2018/0016699 A1 Jan. 18, 2018

Related U.S. Application Data

(62) Division of application No. 14/522,809, filed on Oct. 24, 2014, now Pat. No. 9,777,388.

(51) Int. Cl.
*C25D 21/18* (2006.01)
*C25D 21/14* (2006.01)

(52) U.S. Cl.
CPC ..... *C25D 21/18* (2013.01); *C25D 21/14* (2013.01)

(58) Field of Classification Search
CPC ..... C25D 21/18
See application file for complete search history.

(56) References Cited

U.S. PATENT DOCUMENTS 4,568,431 A * 2/1986 Polan ..... C25D 21/06 204/238
6,032,690 A * 3/2000 Weissfloch ..... F16K 7/126 137/599.08

(Continued)

FOREIGN PATENT DOCUMENTS

DE 2745248 A1 4/1978
EP 2703055 A1 3/2014

(Continued)

*Primary Examiner* — Bryan D. Ripa
(74) *Attorney, Agent, or Firm* — Scully Scott Murphy and Presser; Frank S. DiGiglio

(57) ABSTRACT

Electroplating techniques including an electroplating system and a method for using the electroplating system are provided. The electroplating system has: an electroplating apparatus for electroplating a workpiece, the electroplating apparatus has an electroplating tank configured to contain a solution including target organics; a first reservoir configured to receive the solution including the target organics from the electroplating tank, and to hold the solution including the target organics; a foaming mechanism configured to, in the first reservoir, separate the target organics from the solution through foaming action such that the solution with a reduced concentration of the target organics is separated from a foam including the separated target organics; and a diverting mechanism configured to selectively feed the solution with the reduced concentration of the target organics to one of the first reservoir and the electroplating tank of the electroplating apparatus.

12 Claims, 2 Drawing Sheets

(56) References Cited

U.S. PATENT DOCUMENTS

| | | | | |
|---|---|---|---|---|
| 6,942,779 | B2 * | 9/2005 | Belongia | C25D 21/18 205/101 |
| 2004/0178152 | A1 * | 9/2004 | Morse | B01D 19/0005 210/705 |
| 2011/0056840 | A1 * | 3/2011 | Isono | C25D 21/04 205/296 |
| 2014/0224664 | A1 * | 8/2014 | Kamachi | C25D 21/18 205/99 |

FOREIGN PATENT DOCUMENTS

| | | | |
|---|---|---|---|
| GB | 2497863 | B | 5/2014 |
| JP | 53087572 | A | 8/1978 |
| JP | 5546330 | B2 | 7/2014 |

* cited by examiner

ELECTROPLATING SYSTEM AND METHOD OF USING ELECTROPLATING SYSTEM FOR CONTROLLING CONCENTRATION OF ORGANIC ADDITIVES IN ELECTROPLATING SOLUTION

CROSS-REFERENCE TO RELATED APPLICATIONS

The present application is a divisional of U.S. patent application Ser. No. 14/522,809, filed Oct. 24, 2014 the content of which is incorporated herein by reference in its entirety.

BACKGROUND

The present disclosure relates generally to an electroplating system and a method for using the electroplating system. More particularly, the present disclosure relates to techniques for controlling the concentration of organic additives in an electroplating solution used in an electroplating system.

Generally, an electroplating system is configured to deposit a layer of a metal as a plating material on top of a workpiece that is a different metal to modify one or more surface properties of the workpiece. The workpiece is placed in an electroplating tank containing an electroplating solution. An electrical circuit is created when a negative terminal of a power supply is connected to the workpiece so as to form a cathode and a positive terminal of the power supply is connected to another metal in the electroplating tank so as to form an anode. Electroplating material, typically a stabilized metal ion, is provided in the electroplating solution. During the electroplating process this metal ion is replenished with a soluble metal that forms the anode and/or can be added, directly to the electroplating solution (e.g., as a metal salt). When an electrical current is passed through the circuit, metal ions in the electroplating solution take-up electrons at the workpiece and a layer of metal is formed on the workpiece.

Electroplating solutions can contain organic additives. Different kinds of organic additives are used in electroplating solutions. A first kind or organic additive is referred to as a "brightener." A brightener makes a plating film dense and improves its luster. An example of a brightener is mercaptoalylsulfonic acid ($HS—C_nH_{2n}—SO_3$). This substance exists as an anion in, for example, a copper sulfate plating solution, and prevents the precipitation of a copper ion and promotes its fine division. A second kind of organic additive is referred to as a "suppressor." A suppressor is adsorbed to a cathode surface and suppresses the precipitation of a metal ion to enhance activation polarization and raise uniform electrodensity. Examples of a suppressor include polyethylene glycol (PEG) and polypropylene glycol (PPG). A third kind of organic additive is referred to as a "leveler." A leveler is an organic compound containing nitrogen or oxygen that tends to decrease electroplating rate. An example of a leveler additive is a polyamine.

In electroplating systems, the concentration of organic additives must be closely controlled in the low parts per million range in order to attain desired deposition properties and morphology.

SUMMARY

According to an embodiment of the present invention, an electroplating system is provided. The electroplating system comprises: an electroplating apparatus for electroplating a workpiece, the electroplating apparatus comprising an electroplating tank configured to contain a solution including target organics; a first reservoir configured to receive the solution including the target organics from the electroplating tank, and to hold the solution including the target organics; a foaming mechanism configured to, in the first reservoir, separate the target organics from the solution through foaming action such that the solution with a reduced concentration of the target organics is separated from a foam including the separated target organics; and a diverting mechanism configured to selectively feed the solution with the reduced concentration of the target organics to one of the first reservoir and the electroplating tank of the electroplating apparatus.

According to another embodiment of the present invention, an electroplating system is provided. The electroplating system comprises: a first reservoir configured to receive a solution including target organics from an electroplating tank of an electroplating apparatus for electroplating a workpiece, and to hold the solution including the target organics; a foaming mechanism configured to, in the first reservoir, separate the target organics from the solution through foaming action such that the solution with a reduced concentration of the target organics is separated from a foam including the separated target organics; and a feedback mechanism configured to selectively feed the solution with the reduced concentration of the target organics to one of the first reservoir and the electroplating tank of the electroplating apparatus.

According to another embodiment of the present invention, an electroplating method is provided. The electroplating method comprises: controlling a first reservoir to receive a solution including target organics from an electroplating tank of an electroplating apparatus for electroplating a workpiece, and to hold the solution including the target organics; controlling a foaming mechanism to, in the first reservoir, separate the target organics from the solution through foaming action such that the solution with a reduced concentration of the target organics is separated from a foam including the separated target organics; and controlling a diverting mechanism to selectively feed the solution with the reduced concentration of the target organics to one of the first reservoir and the electroplating tank of the electroplating apparatus.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Figure 1:
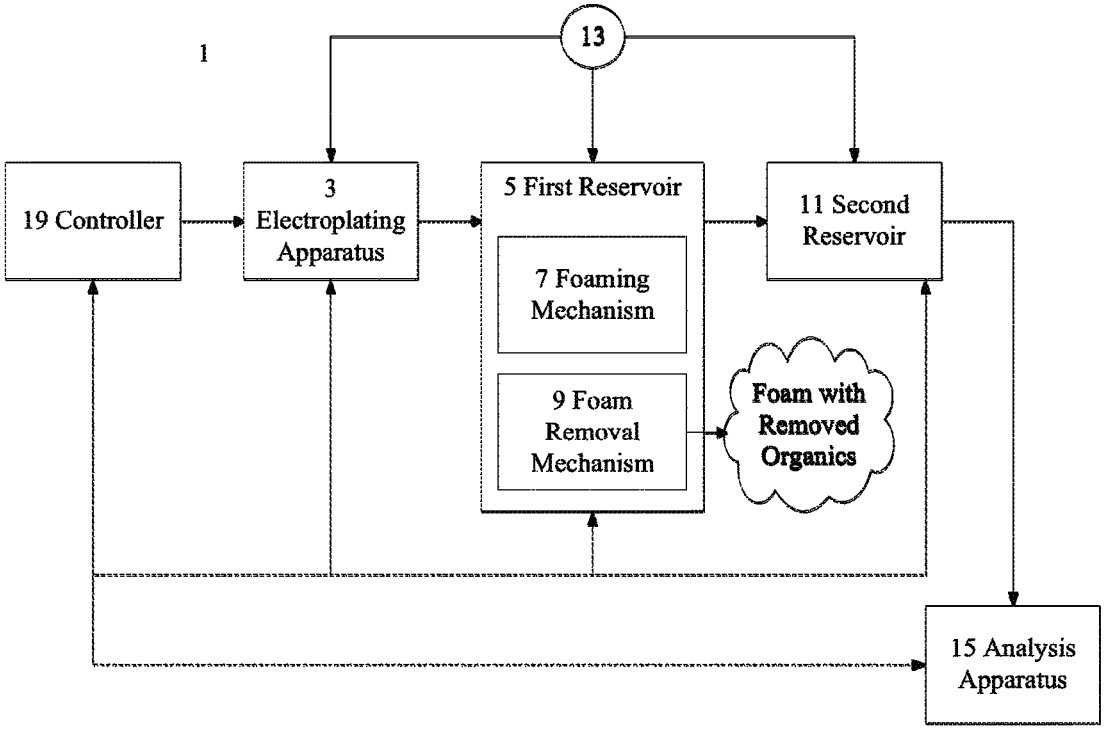
FIG. 1 is a block diagram of an electroplating system according to a first embodiment.

FIG. 1 illustrates an electroplating system 1 according to a first embodiment of the present invention. The electroplating system 1 can include an electroplating apparatus 3, a first reservoir 5, a foaming mechanism 7, a foam removal mechanism 9, a second reservoir 11, a diverting mechanism 13, an analysis apparatus 15, and a controller 17.

The electroplating apparatus 3 is configured to deposit a layer of a metal as a plating material on top of a workpiece that is a different metal to modify one or more surface properties of the workpiece. The workpiece is arranged in an electroplating tank holding an electroplating solution. An electrical circuit is formed when a negative terminal of a power supply is connected to the workpiece so as to form a cathode and a positive terminal of the power supply is connected to another metal in the electroplating tank so as to form an anode. The plating material is typically a stabilized metal ion in the solution. During the plating process this metal ion is replenished with a soluble metal that forms the anode and/or can be added, directly to the electroplating solution (e.g., as a metal salt). When an electrical current is passed through the circuit, metal ions in the electroplating solution take-up electrons at the workpiece and a layer of metal is formed on the workpiece.

The features of the electroplating system 1 for removing (and thereby controlling) organic additives (hereinafter "target organics") from the electroplating solution in the electroplating tank of the electroplating apparatus 3 will be described below.

The first reservoir 5 is configured to selectively receive the electroplating solution including the target organics from the electroplating tank of the electroplating apparatus 3.

The foaming mechanism 7 and the foam removal mechanism 9 are arranged to the first reservoir 5.

The foaming mechanism 7 is configured to cause gas from a gas source to bubble upwardly in the electroplating solution in the first reservoir 5. The resulting gas bubbles attract and bond the target organics as the gas bubbles rise to the top of the electroplating solution such that an organic-rich foam is formed at the top of the electroplating solution in the first reservoir 5. The present invention is not limited by any particular theory of foam formation and instead is based on the application of gas flow in the electroplating solution of the first reservoir 5 to foam the electroplating solution to thereby collect the target organics in the foam and to separate some quantity of the target organics from the electroplating solution in the first reservoir 5.

The foam removal mechanism 9 is configured to remove the foam formed at the top of the electroplating solution in the first reservoir 5 thereby resulting in electroplating solution with a reduced concentration of the target organics in the first reservoir 5.

The second reservoir 11 is configured to selectively receive the electroplating solution with the reduced concentration of target organics from the first reservoir 5.

The diverting mechanism 13 is configured to selectively feed the electroplating solution with the reduced concentration of the target organics from the second reservoir 11 to one of the first reservoir 5 and the electroplating tank of the electroplating apparatus 3.

The analysis apparatus 15 is configured to analyze one or more of: a sample of the electroplating solution from the electroplating apparatus 3; the first reservoir 5; and the second reservoir 11. The analysis apparatus 15 is further configured to analyze the one or more samples to determine the concentration of the target organics in the samples. In particular, the analysis apparatus 15 is configured to analyze the concentration of the target organics in the electroplating solution held in the second reservoir 11.

The controller 19 is configured to determine whether the determined concentration of the target organics is at or below a predetermined concentration. The controller 19 is further configured to control one or more of: the transfer of electroplating solution from the electroplating apparatus 3 to the first reservoir 5; the transfer of electroplating solution from the first reservoir 5 to the second reservoir 11; the foaming mechanism 7; the foam removal mechanism 9; and the diverting mechanism 13, based on the determination of whether the determined concentration of the target organics is at or below the predetermined concentration.

In the present disclosure, transfer of electroplating solution from one container to another container (e.g. from the electroplating tank of the electroplating apparatus 3 to the first reservoir 5; from the first reservoir 5 to the second reservoir 11; and from the second reservoir 11 to one of the first reservoir 5 and the electroplating tank of the electroplating apparatus 3) can be implemented by arrangements of controllable components such as conduits, pumps and valves that are manually controllable or controllable by the controller 19. Other structural examples of components for implementing the transfer of electroplating solutions will be described below.

The controller 19 can be implemented by hardware or a combination of hardware and software. The controller 19 can be embodied in, for example, circuits, a central processing unit (CPU) executing instruction code, and a microprocessor.

In the first embodiment, the analysis apparatus 15 can be a part of a dosing system for controlling the concentration of the target organics in the electroplating tank of the electroplating apparatus 3.

In the first embodiment, the features of the electroplating system 1 for removing the target organics from the electroplating solution can be arranged with the analysis apparatus as part of an analysis system that is separate from and detachably attachable to the electroplating apparatus 3.

Figure 2:
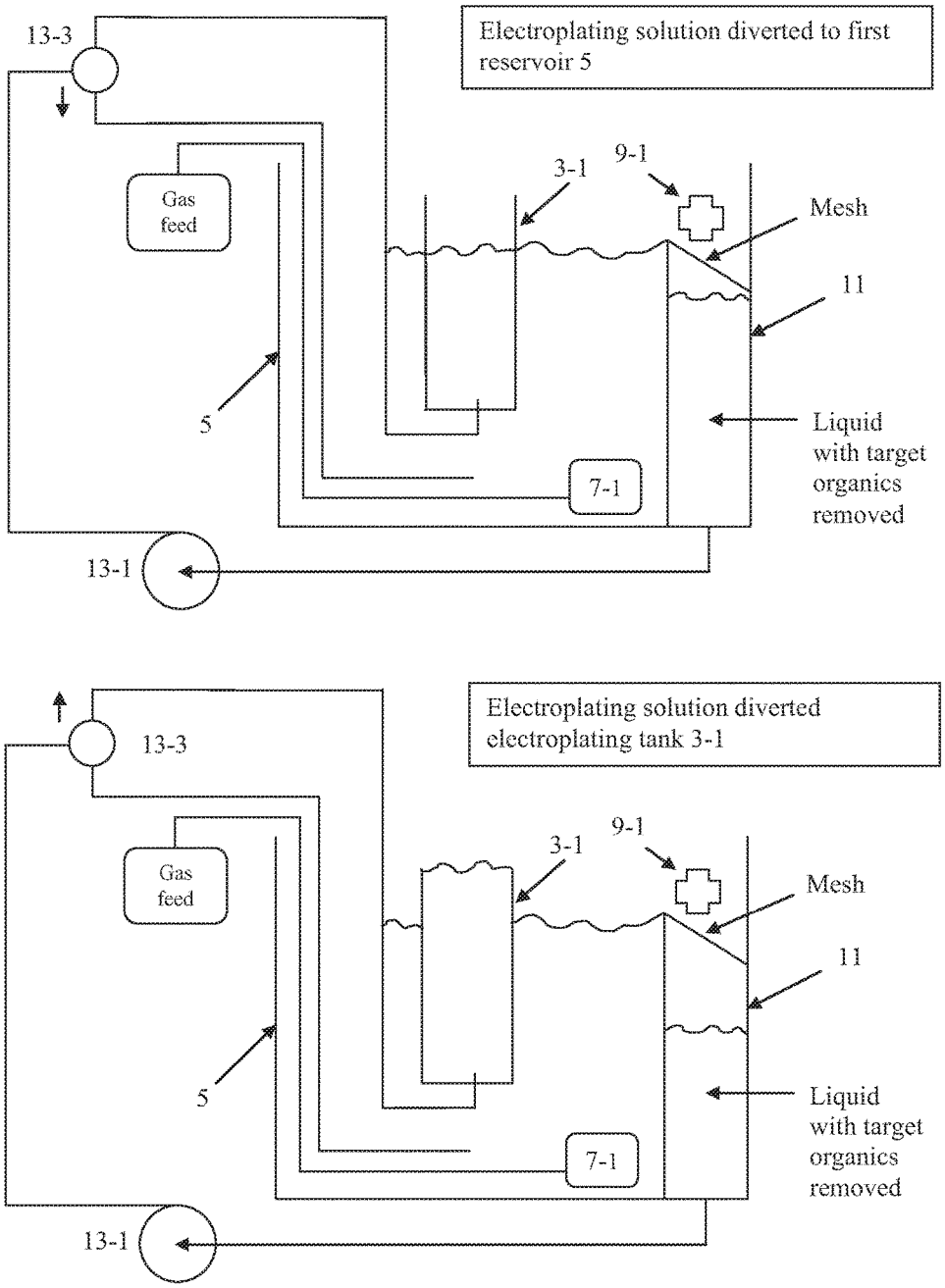
FIG. 2 illustrates an example of the electroplating system according to the first embodiment.

FIG. 2 illustrates an example of the electroplating system 1 according to the first embodiment of the present invention.

The electroplating system 1 includes an electroplating apparatus 3, a first reservoir 5, a foaming mechanism 7, a foam removal mechanism 9, a second reservoir 11, and a diverting mechanism 13.

The electroplating apparatus 3 includes an electroplating tank 3-1 that holds the electroplating solution including organic additives (target organics). A workpiece (cathode) and an anode which are electrically connected to a power supply are arranged in the electroplating solution to form an electrical circuit to plate the workpiece.

The electroplating tank 3-1 can be provided with an inlet (not shown) through which the electroplating solution including the target organics can be introduced into the electroplating tank 3-1.

The first reservoir 5 is arranged relative to the electroplating tank 3-1 to receive the electroplating solution including the target organics from the electroplating tank 3-1. In FIG. 2, the electroplating solution including the target organics can be introduced into the electroplating tank 3-1 through the inlet in the electroplating tank 3-1, and as the electroplating tank 3-1 overflows, the electroplating solution including the target organics cascades from the interior of the electroplating tank 3-1 into the first reservoir 5.

The inlet of the electroplating tank 3-1 can include controllable components such as conduits, pumps, and valves that are controllable by the controller 19 to adjust the volume of the electroplating solution in the electroplating tank 3-1 to thereby control the introduction (through overflow of the electroplating tank 3-1) of the electroplating solution from the electroplating tank 3-1 to the first reservoir 5.

In a modification of the electroplating tank 3-1 and the first reservoir 5, an outlet including controllable components such as conduits, pumps, and valves can be provided between the electroplating tank 3-1 and the first reservoir 5 for controllably introducing the electroplating solution including the target organics from the electroplating tank 3-1 to the first reservoir 5.

The foaming mechanism 7 can include a sparger that is arranged to be below a liquid level of the electroplating solution in the first reservoir 5. The sparger 7-1 is connected through controllable components such as conduits, pumps, and valves to a gas source (e.g. a nitrogen gas source). The gas provided by the gas source can be selected based on, for example, the target organics that are to be separated from the electroplating solution. The sparger 7-1 and the controllable conduits, pumps, and valves can be controlled by the controller 19 to control the properties of the bubbling in the electroplating solution in the first reservoir 5. As one example, the controller 19 can control the sparger 7-1 and the controllable components to continuously or periodically bubble the gas in the electroplating solution in the first reservoir 5. As another example, the controller 19 can control the sparger 7-1 and the controllable components to adjust (e.g. increase or decrease) the rate of bubbling in the electroplating solution in the first reservoir 5 to thereby adjust the amount of foaming in the electroplating solution in the first reservoir 5. Adjustment of the amount of foaming in the electroplating solution in the first reservoir 5 can result in adjustment of the rate at which the target organics is removed from the electroplating solution in the first reservoir 5.

In a modification of the foaming mechanism 7, other structures can replace the sparger 7-1 or can be provided alongside the sparger 7-1 to foam the electroplating solution in the first reservoir 5. Such other structures can include a nozzle (not shown) and controllable components such as conduits, pumps, and valves that spray the electroplating solution held in the electroplating tank 3-1 into the first reservoir 5 to foam the electroplating solution in the first reservoir 5. The nozzle and controllable components can be controlled by the controller 19 to adjust the properties of the bubbling in the electroplating solution in the first reservoir 5. As one example, the controller 19 can control the nozzle and the controllable components to continuously or periodically bubble the gas in the electroplating solution in the first reservoir 5. As another example, the controller 19 can control the nozzle and the controllable components to adjust the rate of bubbling in the electroplating solution in the first reservoir 5 to thereby adjust the amount of foaming in the electroplating solution in the first reservoir 5.

It is also noted that the cascading of the electroplating solution from the electroplating tank 3-1 into the first reservoir 5 may serve to foam the electroplating solution in the first reservoir 5.

The foam removal mechanism 9 can include a paddle wheel 9-1 for actively removing the foam formed by the foaming mechanism 7 in the first reservoir 5. The paddle wheel 9-1 can be controlled by the controller 19 to, for example, continuously or periodically remove the foam formed in the first reservoir 5.

In a modification of the foam removal mechanism 9, other structures can replace the paddle wheel 9-1 or can be provided alongside the paddle wheel 9-1 to actively remove the foam formed in the first reservoir 5. Such other structures can include, for example: an air nozzle (not shown) that is arranged relative to the first reservoir 5 to blow off the foam formed in the first reservoir 5; and a tamp wheel (not shown).

In another modification of the foam removal mechanism 9, a mesh or membrane can be provided to allow the electroplating solution with a reduced concentration of the target organics to pass therethrough and filter out the foam containing the target organics. In an example, the first reservoir 5 can form a weir 5-1 and the mesh or membrane can be arranged to the weir 5-1. The foam including the target organics and the electroplating solution with reduced concentration of the target organics are allowed to overflow across the weir 5-1 and the mesh or membrane. The electroplating solution with the reduced concentration of the target organics is passed by the mesh or membrane into the second reservoir 11 while the foam including the target organics is filtered out by the mesh or membrane and subsequently disposed.

As an alternative to providing the foam removal mechanism 9 for removing the foam (including the target organics) from the electroplating solution with a reduced concentration of the target organics, the first reservoir 5 can be provided with an outlet (not shown) including controllable components such as conduits, pumps, and valves for removing the electroplating solution with the reduced concentration of the target organics from the first reservoir 5. The outlet can be arranged below the level of the foam in the vertical direction of the first reservoir 5 to facilitate removal of the electroplating solution with the reduced concentration of the target organics from the first reservoir 5. The removed electroplating solution with the reduced concentration of the target organics can then be introduced into the second reservoir 11.

The diverting mechanism 13 can include controllable components such as a pump 13-1, a diverter valve 13-3, and conduits for selectively feeding the electroplating solution with the reduced concentration of target organics from the second reservoir 11 to one of the first reservoir 5 and the electroplating tank 3-1 of the electroplating apparatus 3.

The controller 19 is configured to determine whether a determined concentration of target organics in the electroplating solution in the second reservoir 11 is at or below a predetermined concentration. The controller 19 is further configured to control one or more of the pump 13-1 and the diverter valve 13-3 based on the determination of whether the determined concentration of target organics in the electroplating solution in the second reservoir 11 is at or below a predetermined concentration.

In one example, when the controller 19 determines that the determined concentration of target organics in the electroplating solution in the second reservoir 11 is above a predetermined concentration, the controller 19 is configured to divert the electroplating solution in the second reservoir 11 to the first reservoir 5 such that another cycle of foam separation by the foaming mechanism 7 and another cycle of foam removal by the foam removal mechanism 9 can be performed again. In another example, when the controller 19 determines that the determined concentration of target organics in the electroplating solution in the second reservoir 11 is at or below a predetermined concentration, the controller 19 is configured to divert the electroplating solution in the second reservoir 11 to the electroplating tank 3-1 of the electroplating apparatus 3 whereby the electroplating solution can be engaged in another cycle of electroplating or can be re-dosed with an appropriate amount of the target organics to be engaged in another cycle of electroplating.

A method according to a second embodiment of the present invention for using the electroplating system 1 to control the concentration of the target organics in the electroplating solution will be described below.

According to the method, the first reservoir 5 receives and holds the electroplating solution including the target organics from the electroplating tank of the electroplating apparatus 3. The controller 19 can control components such as conduits, pumps, and valves to implement the transfer of the electroplating solution from the electroplating tank of the electroplating apparatus 3 to the first reservoir 5.

In the first reservoir 5, the foaming mechanism 7 separates the target organics from the electroplating solution through foaming action such that electroplating solution with a reduced concentration of the target organics is separated from a foam including the separated target organics. The foam removal mechanism 9 then removes the foam including the separated target organics from the first reservoir 5. The controller 19 can control the foaming mechanism 7 to continuously or periodically apply a gas flow in the electroplating solution to foam the electroplating solution to thereby collect the organics in the foam and to separate a quantity of the target organics from the electroplating solution. The controller 19 can further control the foaming mechanism 7 to change one of the more properties or characteristics of the gas bubbles passed through the electroplating solution including the target organics in the first reservoir 5. Properties or characteristics of the gas bubbles that can be controlled by controller 19 can include the flow rate and size of the gas bubbles.

The second reservoir 11 then receives and holds the electroplating solution with the reduced concentration of the target organics from the first reservoir 5. The controller 19 can control components such as conduits, pumps, and valves to implement the transfer of the electroplating solution with the reduced concentration of the target organics from the first reservoir 5 to the second reservoir 11.

The diverting mechanism 13 then selectively feeds the electroplating solution with the reduced concentration of organics from the second reservoir 11 to one of the first reservoir 5 and the electroplating tank of the electroplating apparatus 3.

The analysis apparatus 15 analyzes one or more of: a sample of the electroplating solution from the electroplating apparatus 3; the first reservoir 5; and the second reservoir 11. The analysis apparatus 15 analyzes the one or more of these samples to determine the concentration of the target organics in the samples.

The controller 19 then determines whether the determined concentration of the target organics in the second reservoir 11 is at or below a predetermined concentration. The controller 19 then controls one or more of: the transfer of electroplating solution from the electroplating apparatus 3 to the first reservoir 5; the transfer of electroplating solution from the first reservoir to the second reservoir 11; the foaming mechanism 7; the foam removal mechanism 9; and the diverting mechanism 13, based on the determination of whether the determined concentration of the target organics is at or below the predetermined concentration.

If the controller 19 determines that the determined concentration of the target organics in the second reservoir 11 is above the predetermined concentration, the controller 19 then controls the diverting mechanism 17 to divert the electroplating solution including the reduced concentration of the target organics to the first reservoir 5 wherein the foaming mechanism 7 and the foam removal mechanism 9 are controlled to further separate and remove the target organics to further reduce the concentration of the target organics in the electroplating solution.

If the controller 19 determines that the determined concentration of the target organics in the second reservoir 11 is at or below the predetermined concentration, the controller 19 then controls the diverting mechanism 17 to divert the electroplating solution including the reduced concentration of the target organics to the electroplating tank of the electroplating apparatus 3.

While the invention has been particularly shown and described with respect to preferred embodiments thereof, it will be understood by those skilled in the art that the foregoing and other changes in form and details may be made therein without departing from the spirit and scope of the present invention.

What is claimed is:

1. An electroplating method comprising:

controlling a first reservoir to receive a solution including target organics from an electroplating tank of an electroplating apparatus for electroplating a workpiece, and to hold the solution including the target organics;

controlling a foaming mechanism to, in the first reservoir, separate the target organics from the solution through foaming action such that the solution with a reduced concentration of the target organics is separated from a foam including the separated target organics; and controlling a diverting mechanism to selectively feed the solution with the reduced concentration of the target organics to one of the first reservoir and the electroplating tank of the electroplating apparatus.

2. The electroplating method according to claim 1, further comprising controlling a foam removal mechanism to remove the foam formed by the foaming mechanism from the first reservoir.

3. The electroplating method according to claim 2, wherein the foam removal mechanism comprises a paddle wheel configured to remove the foam formed by the foaming mechanism from the first reservoir; the method further comprising controlling the paddle wheel to remove the foam formed by the foaming mechanism from the first reservoir.

4. The electroplating method according to claim 1, wherein a second reservoir is configured to receive the solution with the reduced concentration of the target organics that is separated from the foam including the separated target organics, and wherein the step of controlling the diverting mechanism comprises controlling the diverting mechanism to selectively feed the solution with the reduced concentration of the target organics from the second reservoir to one of the first reservoir and the electroplating tank of the electroplating apparatus.

5. The electroplating method according to claim 4, wherein the first reservoir forms a weir, and the first reservoir and the second reservoir are arranged such that the solution with the reduced concentration of the target organics flows over the weir and collects in the second reservoir.

6. The electroplating method according to claim 5, further comprising collecting the foam including the separated target organics with a mesh and passing the solution with the reduced concentration of the target organics to the second reservoir.

7. The electroplating method according to claim 1, wherein the step of controlling the foaming mechanism comprises controlling the foaming mechanism to disperse air or a specific gas in the solution including the target organics to foam the solution such that a quantity of the target organics is collected in the foam.

8. The electroplating method according to claim 7, wherein controlling the foaming mechanism comprises controlling a sparger to disperse the air or the specific gas in the solution including the target organics to foam the solution such that the quantity of the target organics is collected in the foam.

9. The electroplating method according to claim 1, further comprising controlling the diverting mechanism to selectively feed the solution with the reduced concentration of the target organics to one of the first reservoir and the electroplating tank of the electroplating apparatus.

10. The electroplating method according to claim 9, wherein controlling the diverting mechanism to selectively feed the solution with the reduced concentration of the target organics to one of the first reservoir and the electroplating tank of the electroplating apparatus comprises controlling a diverter valve of the diverting mechanism.

11. The electroplating method according to claim 9, wherein the step of controlling the diverting mechanism comprises:

determining whether the concentration of the target organics in the solution is at or below a predetermined concentration; and controlling the diverting mechanism to divert the solution with the reduced concentration of the target organics to the electroplating tank after determining that the concentration of the target organics in the solution is at or below the predetermined concentration.

12. The electroplating method according to claim 1, wherein the electroplating tank is arranged relative to the first reservoir such that a portion of the solution overflowing from the electroplating tank cascades into the reservoir.

* * * * *